US006638168B1

(12) United States Patent
Rehkemper

(10) Patent No.: US 6,638,168 B1
(45) Date of Patent: Oct. 28, 2003

(54) SOUND ELIMINATION GAME AND APPARATUS

(76) Inventor: Steve Rehkemper, 1300 W. Washington, Chicago, IL (US) 60607

( * ) Notice: Subject to any disclaimer, the term of this patent is extended or adjusted under 35 U.S.C. 154(b) by 435 days.

(21) Appl. No.: 09/631,815

(22) Filed: Aug. 3, 2000

(51) Int. Cl.[7] ..... A63F 9/24

(52) U.S. Cl. ..... 463/35; 273/454; 273/460; 446/397

(58) Field of Search ..... 463/1, 7, 9, 23, 463/35; 434/247, 258, 308; 273/237, 153 R, 440, 432, 454, 460; 446/297, 397, 404, 408, 484, 485

(56) References Cited

U.S. PATENT DOCUMENTS

| | | | | |
|---|---|---|---|---|
| 4,326,710 A | | 4/1982 | Breslow et al. | |
| 4,336,935 A | | 6/1982 | Goldfarb | |
| 4,363,482 A | | 12/1982 | Goldfarb | |
| 5,106,097 A | | 4/1992 | Levine | |
| 5,145,447 A | | 9/1992 | Goldfarb | |
| 5,342,047 A | * | 8/1994 | Heidel et al. | 463/12 |
| 5,368,308 A | | 11/1994 | Darnell | |
| 5,405,153 A | | 4/1995 | Hauck | |
| 5,947,478 A | | 9/1999 | Kwan et al. | |
| 6,010,339 A | * | 1/2000 | McDonald | 434/258 |
| 6,079,985 A | * | 6/2000 | Wohl et al. | 434/319 |

* cited by examiner

*Primary Examiner*—Jessica Harrison
(74) *Attorney, Agent, or Firm*—Roy A. Ekstrand

(57) ABSTRACT

A sound elimination game and apparatus includes an electronic game having a housing supporting a plurality of user depressible button thereon. Each button is supported within the housing by a light and button assembly and includes a latent image and means for illuminating the latent image. A control circuit is supported within the housing and is operative to selectively illuminate one or more of the light and button assemblies to reveal the latent image thereon. The control circuit is further operative to activate a sound circuit also within the housing to provide character sounds in association with the illuminated buttons on the housing. Game play is provided in which the entire group of character buttons is simultaneously illuminated and in which the character sounds associated with all of the character buttons is simultaneously sounded.

15 Claims, 4 Drawing Sheets

SOUND ELIMINATION GAME AND APPARATUS

FIELD OF THE INVENTION

This invention relates generally to electronic game and particularly to those operative to develop memory and concentration skills among game participants.

BACKGROUND OF THE INVENTION

Electronic games have become an extremely well known and popular type of game product in the toy art. With the relatively recent development of low-cost mass-produced microprocessor based circuits, a dramatic increase has been obtained in the capability of such electronic games. Even the most modest of electronic games utilizes a microprocessor which is relatively fast and includes a significant amount of memory. Such circuits take advantage of the,economies of digital signal processing and thus, are for the most part "software driven". Correspondingly, manufacturing cost of other associated apparatus of the type used in such electronic games has also benefited from high volume production and has been dramatically reduced. Previously expensive electronic components such as light emitting diodes (LED's), sound circuits, audio transducers such as piezoelectric transducers, microprocessor memory and the like have allowed practitioner's in the art to respond to the popularity of electronic games by producing a virtually endless variety of highly entertaining and amusing games.

Perhaps one of the earliest and most significant commercial products in the electronic game art which introduced many consumers to electronic games was a game generally known as "Simon Sez". The electronic Simon Sez game was to some extent an electronic replication of a long existing child's game in which a leader issued various commands to the participant's challenging the participant's to correctly respond to valid commands such as "Simon Sez stand up" and to reject or ignore invalid claims such as "stand up" which lack the appropriate Simon Sez preface. The electronic version of this game utilized an apparatus having the capability to illuminate a plurality of differently colored buttons on a game housing while producing corresponding musical tones associated with each. The game play involved the initial presentation by the game unit of one or more lighted buttons and accompanying tones in a given sequence. Thereafter, the player was challenged to repeat the same sequence by pressing the previously lighted buttons in the appropriate order. As the player successfully repeated each sequence portion, the game then replayed the sequence and added an additional button thereto further challenging the player.

The popularity of such early electronic games prompted practitioner's in the art to provide a continuous array of electronic games having increasing levels of complexity and amusement. For example, U.S. Pat. No. 4,326,710 issued to Breslow et al sets forth a TALKING ELECTRONIC GAME having an integrated circuit voice synthesizer to generate a plurality of beginning phrases each forming the beginning of a complete phrase. The apparatus further produces a plurality of ending phrases each forming the end of a complete phrase. The beginning and ending phrases are assigned at random to a plurality of push buttons and the object of the game is to match up the beginning and ending phrases of various sentences by appropriate actuation of the various push buttons.

U.S. Pat. No. 4,336,935 issued to Goldfarb sets forth a MUSICAL GAME APPARATUS having a housing generally resembling a miniature jukebox having a plurality of depressible buttons and apparatus for playing musical notes. The apparatus is operated in various game modes ranging from low difficulty to substantially difficulty.

U.S. Pat. No. 4,363,482 issued to Goldfarb sets forth a SOUND RESPONSIVE ELECTRONIC GAME having apparatus for generating a series of player-interrogation signals and maintaining a series of correct responses. The correct sequences is defines in accordance with established game rules which are known to the players. The game apparatus receives actual auditory and switch closure responses from the players, compares the responses with the correct sequence, and indicates visually and auditory whether each response is correct.

U.S. Pat. No. 5,106,097 issued to Levine sets forth an AUDIO QUIZ GAME in which a player attempts to answer a question after listening to a corresponding audio clip provided on a compact disk. Each track of the compact disk contains one or more'sound clips separated by audio cues. The questions and answers relating to specific tracks are provided in a book, or playing cards, or in a computer memory and may be randomly accessed.

U.S. Pat. No. 5,145,447 issued to Goldfarb sets forth a MULTIPLE CHOICE VERBAL SOUND TOY having a housing supporting a plurality of depressible keys and an audio circuit for producing verbal sound. The audio circuit uses a microprocessor to produce one sound or poem that has at least one space or slot for introducing a supplementary verbal sound segment to complete the song or poem. The child user is given a plurality of different choices for segments for completing the song or poem.

U.S. Pat. No. 5,638,308 issued to Danell set forth a SOUND RECORDING AND PLAYBACK SYSTEM having electronic apparatus which brakes a stream of recorded sound into discreet segments. The apparatus randomizes the order of the sound segments and allows the sound segments to be reordered to their original sequence or some other desired order.

U.S. Pat. No. 5,405,153 issued to Hauck sets forth a MUSICAL ELECTRONIC GAME having apparatus for randomly selecting a sequence of musical notes and for, presenting a recognizable sequence of notes to the user. A switch device actuated by the player causes a signal to be generated indicative that the player identified the recognition sequence of notes within those previously presented.

U.S. Pat. No. 5,947,478 issued to Kwan et al sets forth a TOY ELECTRONIC GAME WITH FLEXIBLE INTERACTIVE PLAY SECTION having an electronic game processor unit and a flexible play panel upon which a plurality of visual indicia are supported. A plurality of depressible buttons also of flexible structure are supported beneath the invisible indicia and are operatively coupled to the circuitry of the game. The panel may be rolled up for convenient storage between use.

While the foregoing described prior art devices have generally improved the art and in some instance enjoyed commercial success, there remains nonetheless a continuing need in the art for ever more unusual, novel and entertaining electronic games.

SUMMARY OF THE INVENTION

Accordingly, it is a general object of the present invention to provide and improved electronic game and apparatus. It is a more particular object of the present invention to provide an improved electronic game and apparatus which effectively uses sound and visual effects.

In accordance with the present invention there is provided a game comprising: a housing; a plurality of light and button assemblies supported by the housing, each having a depressible button and a latent image; a control circuit, within the housing, having a microprocessor and associated memory and a sound circuit for producing sounds associated with each of the latent images; and means for illuminating each of the depressible buttons to reveal the latent image thereon, the microprocessor and the associated memory operative to perform game play which includes randomly selecting one of the light and button assemblies and operating the means for illuminating and the sound circuit to reveal a selected latent image and produce an associated sound and thereafter simultaneously reveal a plurality of the latent images and produce a corresponding plurality of the associated sounds.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE EMBODIMENTS

Figure 1:
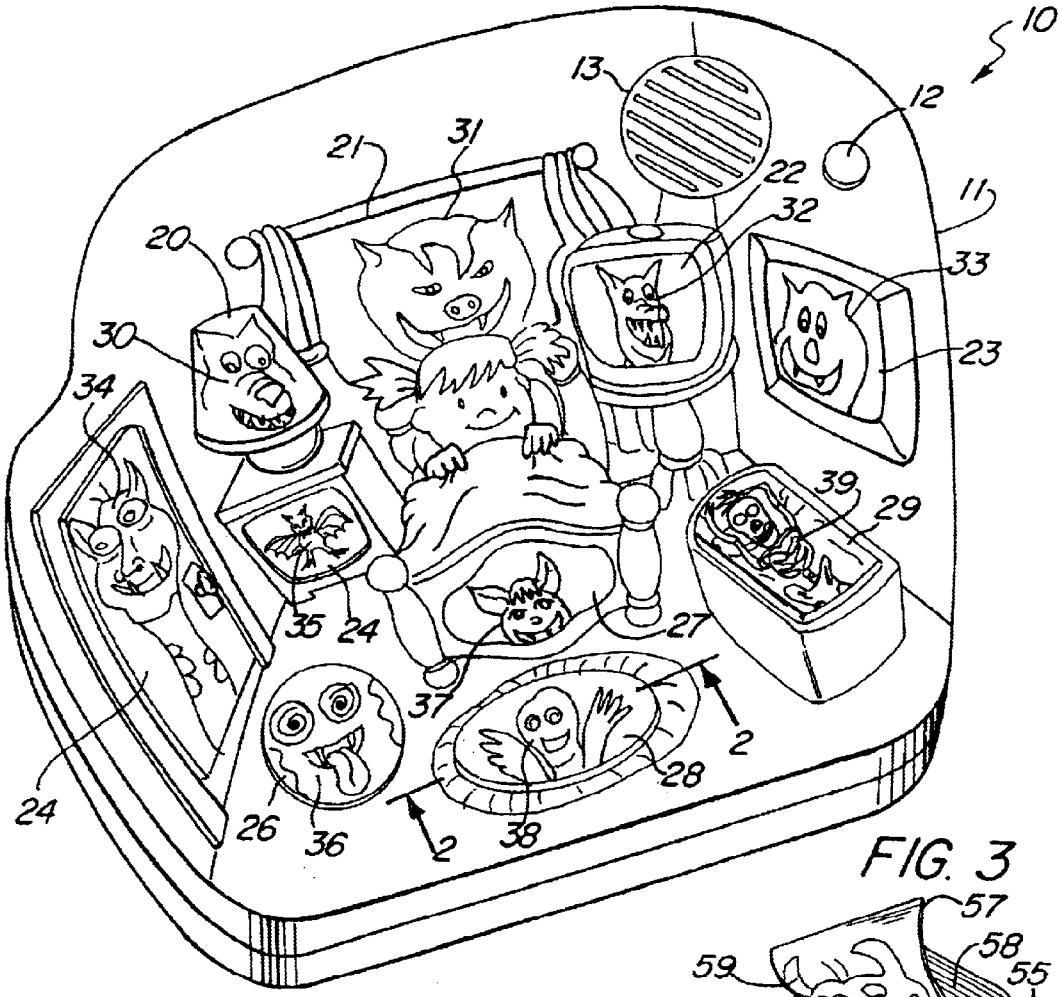
FIG. 1 sets forth a perspective view of a sound elimination game apparatus constructed in accordance with the present invention.

FIG. 1 sets forth a perspective view of an electronic game constructed in accordance with the present invention and generally referenced by numeral 10. Electronic game includes a housing 11 supporting a start button 12 and a plurality of depressible buttons 20 through 29. A scene image is formed upon housing 11 which in the illustration of FIG. 1 is a fanciful representation of a child's bedroom. It will be apparent to those skilled in the art that other image scenes may be used which employ alternative scenes and images without departing from the spirit and scope of the present invention. Housing 11 supports a plurality of depressible buttons 20 through 29 which bear respective latent images 30 through 39. For purposes of illustration, latent images 30 through 39 are shown in FIG. 1. However, in accordance with operation of game 10 set forth below in greater detail, in a typical play pattern certain ones of latent images 30 through 39 will be visible while others will be invisible at any particular moment of game play. In accordance with the apparatus set forth below in FIG. 2, latent images 30 through 39 are preferably transformed from invisible to visible by illumination of the interior structure of buttons 20 through 29. Thus, the operative circuit means set forth below in FIG. 4, operates to selectively illuminate one or more of buttons 20 through 29 to display latent images 30 through 39.

Figure 4:
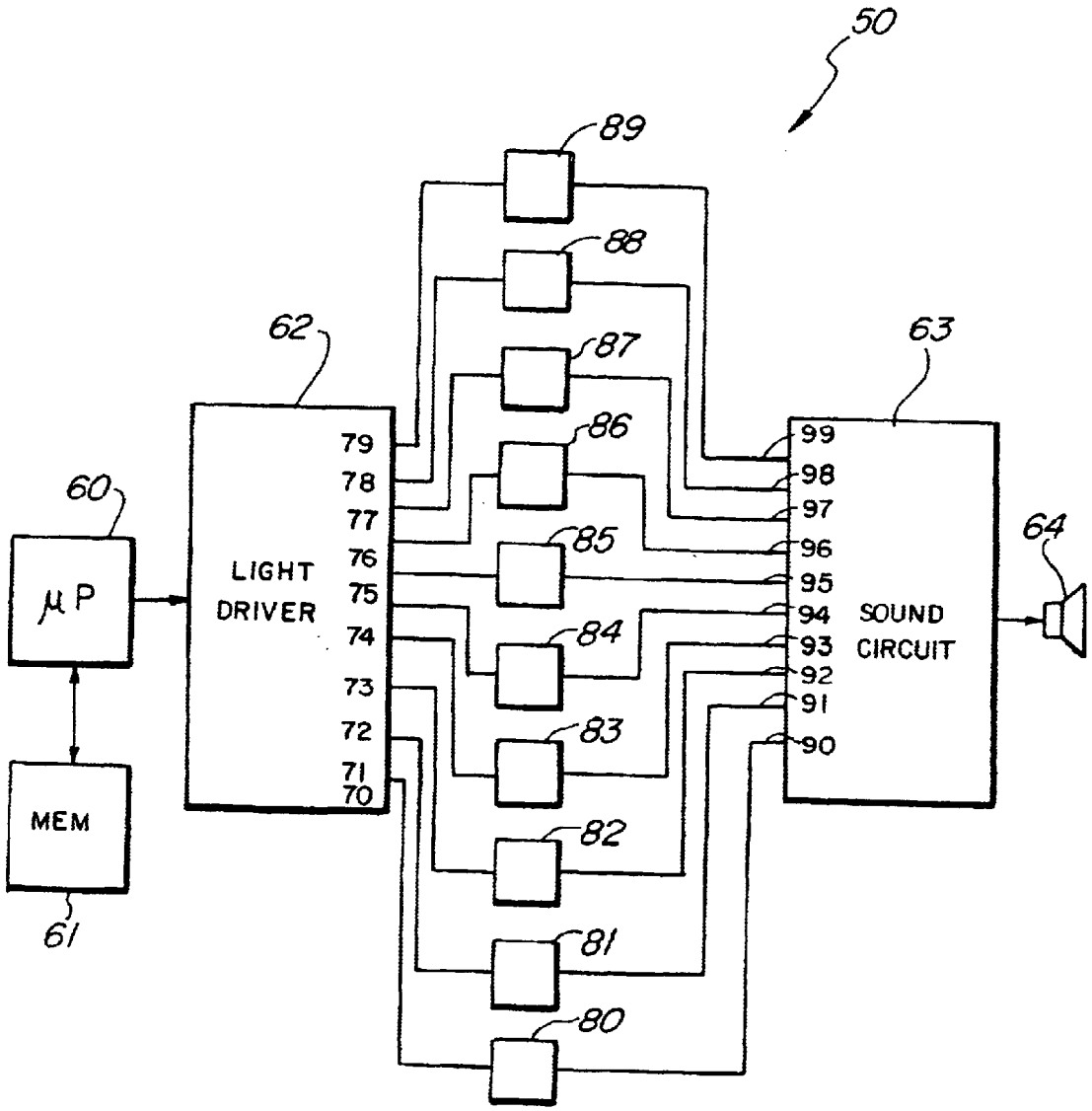
FIG. 4 sets forth a block diagram of the sound and button circuit of the present invention game and apparatus.

In further accordance with the present invention, electronic game includes a sound circuit 63 driving a small speaker 64 (seen in FIG. 4). Correspondingly, housing 11 supports a speaker grille 13 which allows sound produced by speaker 64 pass outwardly through grille 13 to be readily heard by the user.

In operation, and in accordance with the game play set forth below in FIGS. 5 and 6, electronic game 10 is capable of playing a plurality of games which preferably includes a pair of novel games shown in FIGS. 5 and 6. Suffice it to note here, that electronic game 10 may for example play sound and illumination game in which a selected one of buttons 20 through 29 and images 30 through 39 is randomly chosen by the circuit within housing 11. Thereafter, the circuit within housing 11 illuminates the selected one of buttons 20 through 29 thereby displaying the selected one of images 30 through 39. Correspondingly, sound circuit 63 (seen in FIG. 4) produces a particular sound associated with each of buttons 20 through 29 and images 30 through 39 when each is illuminated. Thus, as the selected image and button is illuminated, a corresponding sound is played. Thereafter, the ,operative circuit within housing 11 illuminates all of buttons 20 through 29 simultaneously thereby displaying of latent images 30 through 39 and causing the associated sounds therewith to be simultaneously played. The player is then challenged to recognize the selected sound from among the plurality of sounds being played and depress the corresponding button relating thereto. In the event the player is successful, the game is restarted and the time interval for successful play is shortened. In the event the player is unsuccessful, a loss signal is provided and the game is restarted.

In an alternative game play, the various sounds associated with each of latent images 30 through 39 and buttons 20 through 29 are arranged sequentially from a loudest volume to a lowest volume and all of buttons 20 through 29 are simultaneously illuminated and their accompanying sounds simultaneously play. The result is the simultaneous display of all of latent images 30 through 39 and the playing of their associated sounds. The player is then challenged to sequentially press the buttons associated with each latent image in the correct order starting with the loudest sound and working toward the lowest volume sound. Indications are provided for correct play and incorrect play. Each time the play successfully presses a button in the correct order of decreasing volume, that button illumination is terminated and its corresponding sound is deleted. The player wins by pressing the entire sequence of buttons in the correct order.

Figure 2:
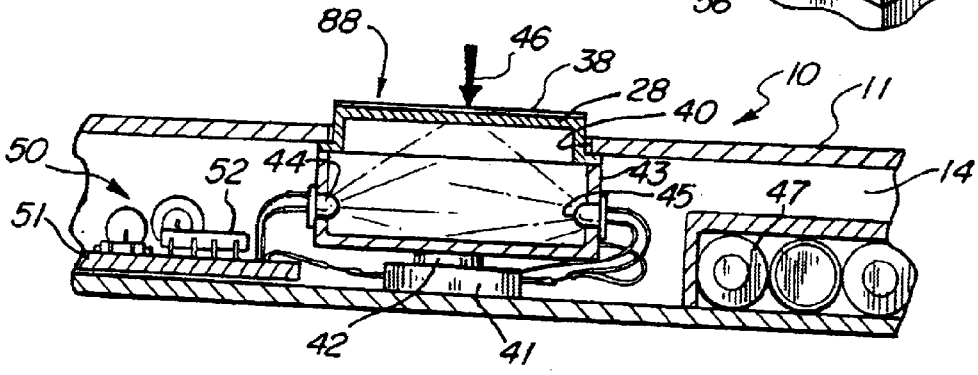
FIG. 2 sets forth a partial section view of a portion of the present invention game of FIG. 1 taken along section lines 2—2 therein.

FIG. 2 sets forth a partial section view of electronic game 10 taken along section lines 2—2 in FIG. 1. It will be understood that the structure set forth in FIG. 2 which shows the details of button 28 bearing latent image 38 is representative of the remaining buttons supported upon housing 11 and there associated apparatus. Thus, the descriptions set forth in FIG. 2 relating to the structure supporting button 28 will be understood to be equally descriptive of the structure supporting buttons 20 through 27 and button 29.

More specifically, electronic game 10 includes a housing 11 defining an interior cavity 14. Housing 11 further defines an aperture 40. A conventional battery power supply 47 is supported within interior 14. A control circuit 50 constructed in accordance with conventional fabrication techniques, includes printed circuit board 11 and a plurality of electronic circuit components such as component 52. In accordance with conventional fabrication techniques, control circuit 50 utilizes a plurality of integrated circuit components to form the operative circuit shown in schematic diagram in FIG. 4.

Electronic game 10 includes a light and button assembly 88 having a depressible button 28 extending through aperture 40 and a housing 43 supporting button 28. A switch 41 having a depressible button actuator 42 is supported beneath housing 43 and provides a supporting force which maintains housing 43 as shown and maintains the extension of button 28 through aperture 40. In accordance with an important aspect of the present invention, button 28 supports a latent image 38 on the upper surface thereof. Switch 41 is constructed in accordance with conventional fabrication techniques, and is a normally open switch in the absence of depression of button 42. If desired, an additional return spring may be supported within interior 14 to urge housing 43 and button 28 upwardly. However, it has been found sufficient to utilize the return spring force of switch 41 to maintain the position of housing. 43 and button 28. Housing 43 further supports a pair of light emitting diodes (LEDs) 44 and 45. In the preferred fabrication of the present invention, LED 45 is directly wired to switch 41 and to control circuit 50 to provide illumination thereof each time switch 41 is actuated. In addition, LED 44 is controlled by the operation of control circuit 50 and is selectively illuminated in accordance with the above described game play as desired.

In accordance with an important aspect of the present invention, latent image 38 supported upon button 28 utilizes light passing through button 28 produced by either LED 44 or LED 45 to provide the illumination of the latent image. In the preferred fabrication of the present invention, button 28 is fabricated of a light transmissive plastic material which may be either clear or tinted or translucent., In the illustration of game play set forth above in FIG. 1, each of the latent images forming latent images 30 through 39 is a representation of a game play character. Correspondingly, each of the sounds produced in association with each latent image corresponds in some manner to the sounds associated with such character. It will be apparent to those skilled in the art however, that other sound and character association may be utilized without departing from the spirit and scope of the present invention.

In operation, each time button 28 is forced downwardly in the direction indicated by arrow 46, switch 41 is actuated as housing 43 and button 28 moves downwardly. The actuation of switch 41 causes LED 45 to be illuminated thereby revealing latent image 38. Correspondingly, the actuation of switch 41 is communicated to control circuit 50 to provide input to control circuit 50 of the pressing of button 28. This input is utilized in the manner described below to provide game play. Additionally, in the absence of actuation of,switch 41 by pressing on button 28, control circuit 50 is able to energize LED 44 as desired to illuminate latent image 38 and provide the various game play actions described below.

Figure 3:
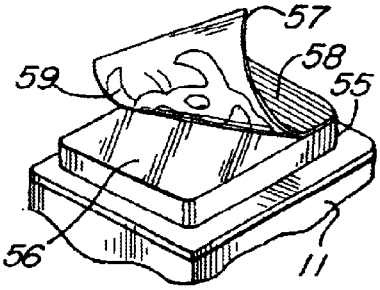
FIG. 3 sets forth a partial perspective view of an illustrative interactive button element of the present invention game apparatus.

FIG. 3 sets forth a partial perspective view of an illustrative button structure having an image formed thereon. Accordingly, housing 11 supports a button 55 having an upper surface 56. An image sheet 57 formed of a partially light transmissive material such as translucent plastic or the like support a latent image 59 on the undersurface thereof. A translucent surface 58 is formed on the opposite side of sheet 57. As a result, in the absence of illumination of button 55 translucent surface 58 obscures latent image 59 and image sheet 57 and button 55 do not display an image. Once button 55 is illuminated however, light passes upwardly through surface 56 illuminating image 59 producing an image which passes outwardly through translucent surface 58 and resulting in image display.

FIG. 4 sets forth a schematic block diagram of control circuit 50 in combination with light and button assemblies 80 through 89. It will be apparent to those skilled in the art, that control circuit 50 may be fabricated in accordance with conventional fabrication techniques typical of small electronic microprocessor driven circuitry of the type commonly used in toys and other apparatus.

More specifically, control circuit 50 includes a microprocessor 60 and memory 61 associated therewith. Microprocessor 60 and memory 61 are fabricated in accordance with conventional fabrication techniques such that microprocessor 60 operates in accordance with a stored program or instruction set residing within memory 61. FIGS. 5 and 6 set forth flow diagrams of the operative game play software within memory 61. Control circuit 50 further includes a light driver having an input coupled to microprocessor 60. Light driver 62 is fabricated in accordance with conventional fabrication techniques and operates in response to digital commands provided by microprocessor 60 to selectively activate a plurality of devices operatively coupled to light driver 62. Accordingly, light driver 62 includes a plurality of outputs 70 through 79 each operatively coupled to a respective one of light and button assemblies 80 through 89. It will be recalled from FIG. 2 and the descriptions utilized in connection therewith that light and button assemblies 80 through 89 utilize the structure set forth in FIG. 2 to provide illumination of a selected light button assembly by pressing the associated button supported thereby.

Returning to. FIG. 4, control circuit 50 further includes a conventional sound circuit 63 having a plurality of inputs 90 through 99. Sound circuit 63 is further coupled to a conventional electro-acoustic transducer represented in FIG. 4 by a speaker 64. Sound circuit 63 is fabricated in accordance with conventional fabrication techniques and utilizes an internal memory having stored audio data and a microprocessor having a stored instruction set operative to provide appropriate output audio signals in response to one or more inputs. It will be well understood by those skilled in the art, that virtually any standard sound circuit may be utilized in place of sound circuit 63. The essential characteristic of sound circuit 63 is the provision of appropriate signals to speaker 64 for audibilizing a predetermined speech message or sound combination each time an input signal is received at one or more of inputs 90 through 99. For example, a combination of a microprocessor, read only memory, audio synthesizer and audio output amplifier suitable for functioning as sound circuit 63 is formed as a single integrated circuit chip device manufactured by Texan Instruments, Inc. under the device name TMS 50C44. However, it will be understood that a variety of sound integrated devices may be utilized for sound circuit 63.

Figure 5:
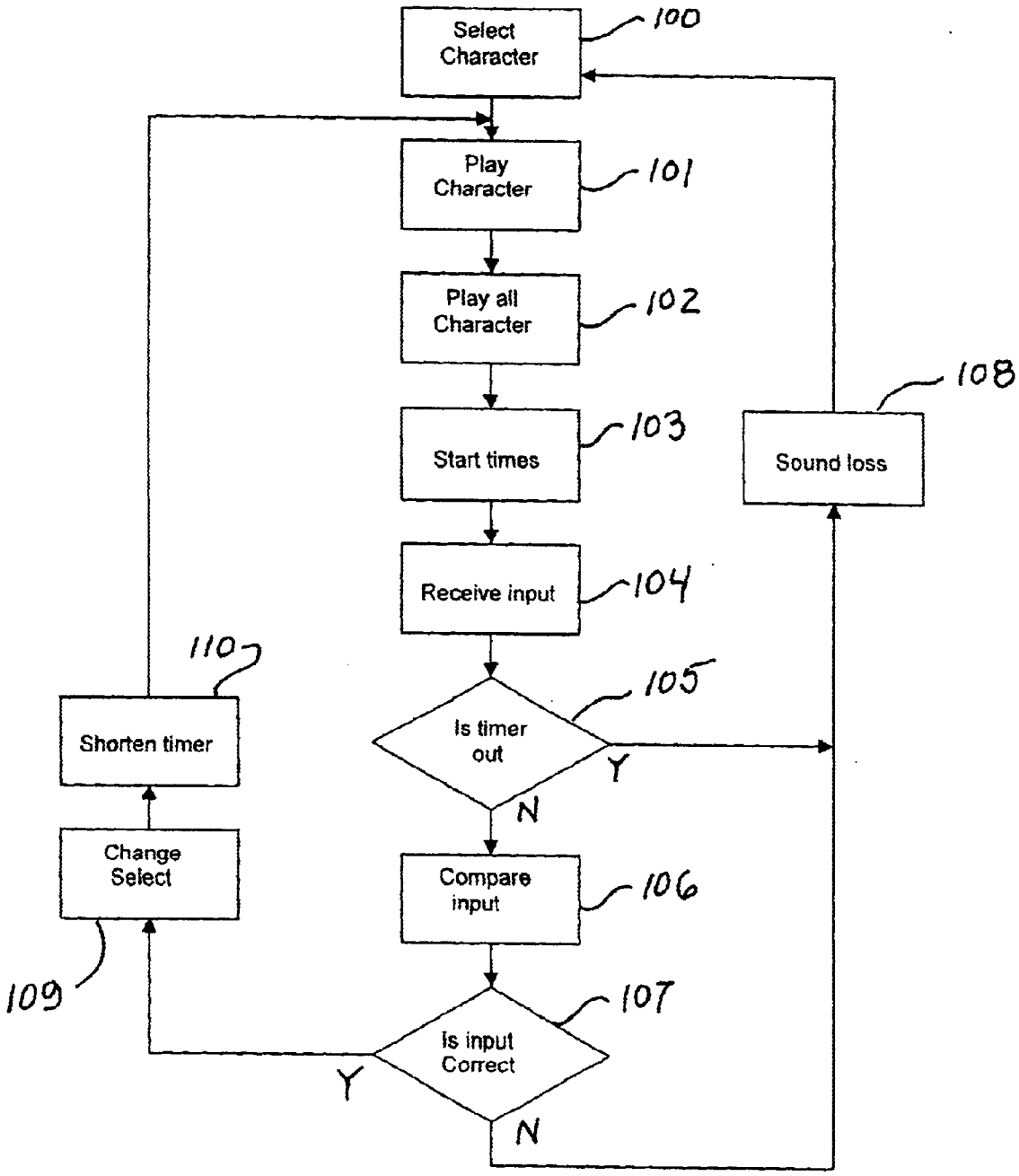
FIG. 5 sets forth a flow diagram of game play of the present invention game and apparatus.
Figure 6:
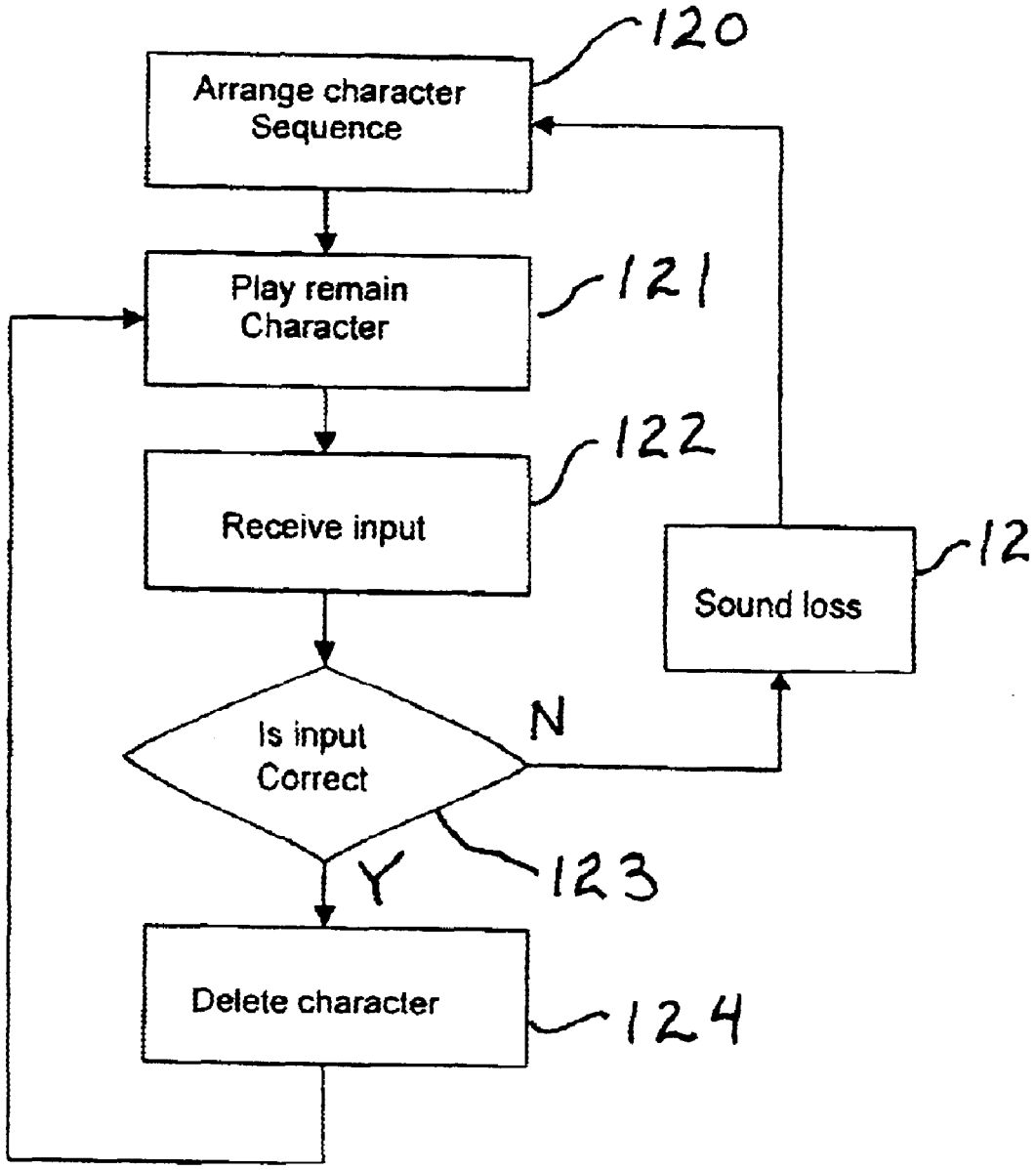
FIG. 6 sets forth a block diagram of an alternate game play of the present invention game and apparatus.

In operation, microprocessor 60 operates in accordance with a stored game play instruction set to play either of the games set forth in the flow diagrams of FIGS. 5 and 6. Microprocessor 60 provides output signals which are utilized by light driver 62 to energize one or more of outputs 70 through 79. Light and button assemblies 80 through 89 respond to the applied output signals from light driver 62 to activate the LED within the selected light and button assembly. In addition, the output signal of light driver 62 is also applied to one or more of inputs 90 through 99 of sound circuit 63. In response to each inputs at inputs 90 through 99, sound circuit 63 produces output signals relating to the corresponding one of light and button assemblies 80 through 89 to energize speaker 64 and provide accompanying sound. Thus, the user is able to alternatively manually press the associated button of light and button assemblies 80 through 89 in the manner set forth above in FIG. 2, to energize the LED supported therein and illuminate the image while triggering output from sound circuit 63. In alternative operation, light and button assemblies 80 through 89 and sound circuit 63 respond to output signals from light driver 62.

FIG. 5 sets forth a flow diagram of the operation of microprocessor 60 in controlling control circuit 50 (seen in Figure) to operate the present invention sound elimination game apparatus in accordance with the present invention game play. At an initial step 100, microprocessor 60 randomly selects one of the light and button assemblies supported upon housing 11 (seen in FIG. 1). As described above, the example of the present invention game play set forth in FIG. 1, associates a character image With each of buttons 20 through 29. Accordingly, in the game play of FIG. 5, random selection step 100 comprises the selection of a character from among the plurality of characters supported by each of the buttons of the present invention electronic game. Thereafter, at a step 101, microprocessor plays the selected character by illuminating the light and button housing associated therewith and activating the sound circuit to produce its associated sound. Next, at a step 102, microprocessor 62 activates all of the light and button assemblies illuminating all characters and causes the output of all of the associated sound messages simultaneously. At step 103, a timer is activated and at a step 104 the system waits for a selected input from the game player. In the game illustrated in FIG. 5 which is referred to above briefly, the game objective is to challenge the user to press the button associated with the character selected at step 100 and played at step 101 from the plurality of characters played at step 102. Thus, at step 104 a user input in a form of a button pressing is received. With the user input received, a determination at step 105 takes place as to whether the timer initiated at step 103 has timed out ending the players turn. If this has taken place, the system moves to a step 108 in which a loss or negative sound is played and thereafter returns to step 100 to initiate a new round of game play. If however at step 105 it is determined that the time interval has not passed the system moves to a step 106 at which the input at step 104 is compared to the selected character at step 100. At step 107, a determination is made as to whether the comparison in step 106 shows a correct response. If the response is not correct, the system moves to step 108 initiating a loosing sound and returning to step 100. If however a determination is made at step 107 that the response was correct, the system moves to step 109 and randomly selects a different character. Thereafter, the system moves to a step 110 in which the timer interval is shortened to further challenge the player. Thereafter, the system returns to step 101 playing the character selected at step 109 and commencing an additional round of play at a shorter timer interval. This process continues until the player is able to perform in the shortest of the timer intervals which in turn constitutes winning the game.

FIG. 6 sets forth a flow diagram of the operation of microprocessor 60 (seen in FIG. 4) performing an alternative form of the present invention game play. The game play of FIG. 6 commences at a step 120 in which the characters supported in the latent images of light and button assemblies 80 through 89 (seen in FIG. 4) are arranged in a predetermined character sequence. In the preferred fabrication of the present invention, the character sequence arranged at step 120 places the characters and their associated sounds at a descending order of sound volume or loudness. The system then moves to step 121 in which the remaining characters which in the initial round following step 120 comprises all of the characters are played simultaneously. Thereafter, at step 122 the system awaits a user input as the game player attempts to press the button associated with the loudest volume sound and its character. Once a user input has been received at step 122, a determination at step 123 as to whether the input was a correct selection. In the game play of FIG. 6, and in accordance with the arrangement of characters initially structured at step 120, the inquiry at step 123 is a determination as to whether the button associated with the loudest volume sound character has been selected. In the event the user has failed to correctly select the loudest sound, the system moves to a step 125 producing a loss or looser sound message and returning to step 120 to initiate another round of game play. If however the correct input has been determined at step 123, the system moves to step 124 and deletes the loudest character. Thereafter, the system returns to step 121 and plays all of the remaining characters simultaneously. The player then moves through step 122 attempting to select the loudest character sound from the remaining sounds and proceeds in the next round of game play. This game play continues until the user either selects incorrectly thereby using the game or successfully deletes each character sound in accordance with the loudness sequence and wins the game.

It has been found that the present invention sound elimination game and apparatus provide a significant increase in the amusement and entertainment as well as the challenge afforded which has not been provided by prior art sound games. The use of a plurality of sounds simultaneously generated and the game play which variously challenges the user to discriminate between simultaneous sounds and characters and select a predetermined sound and character is extremely challenging. It is also extremely entertaining in that a great deal of light and sound activity is taking place as the user plays the game. The present invention game and apparatus may be operated in accordance with conventional fabrication integrated circuit technology of the type which is readily available for devices such as electronic games and the like.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A game comprising:

a housing;

a plurality of light and button assemblies supported by said housing, each having a depressible button and a latent image;

a control circuit, within said housing, having a microprocessor and associated memory and a sound circuit for producing sounds associated with each of said latent images; and means for illuminating each of said depressible buttons to reveal the latent image thereon, said microprocessor and said associated memory operative to perform game play which includes randomly selecting one of said light and button assemblies and operating said means for illuminating and said sound circuit to reveal a selected latent image and produce an associated sound and thereafter simultaneously reveal a plurality of said latent images and produce a corresponding plurality of said associated sounds.

2. The game set forth in claim 1 wherein each of said light and button assemblies each include a button housing supporting one of said depressible buttons and wherein said means for illuminating includes a plurality of light emitting diodes supported within each said button housings.

3. The game set forth in claim 2 wherein said plurality of light and button assemblies;each include a switch activated when said depressible button is depressed and wherein each of said light and button assemblies include a light emitting diode for illuminating one of said latent images.

4. A method of playing a game comprising the steps of:

providing a game housing having a plurality of depressible buttons each supporting a latent image and means for illuminating each of said buttons to reveal said latent image and means for producing sounds associated with said latent images;

selecting one of said depressible buttons as a selected depressible button;

selectively illuminating said selected depressible buttons and producing its associated sounds;

illuminating a plurality of said depressible buttons and producing said associated sounds, said plurality of depressible buttons including said selected depressible button;

receiving a user input resulting from a user's attempt to identify said selected depressible button;

indicating an incorrect choice in the event the user's input is not said selected depressible button; and indicating a correct choice in the event the user's input is said selected depressible button.

5. The method of playing a game set forth in claim 4 wherein said plurality of said depressible buttons illuminated in said illuminating step includes all of said depressible buttons.

6. The method of playing a game set forth in claim 5 wherein said step of receiving a user input includes determining whether said user input is received within a response time.

7. The method of playing a game set forth in claim 6 wherein said step of indicating a correct choice includes the step of establishing a reduced duration response time for the next game play.

8. The method of playing a game set forth in claim 4 wherein said selecting step includes the step of selecting the loudest of said associated sounds.

9. The method of playing a game set forth in claim 8 wherein said step of indicating a correct choice includes the steps of:

deleting the loudest of said associated sounds; and selecting the next loudest of said associated sounds.

10. A game comprising:

a housing;

a plurality of light and button assemblies supported by said housing, each having a depressible button and a latent image;

a control circuit, within said housing, having a microprocessor and associated memory and a sound circuit for producing sounds associated with each of said latent images; and means for illuminating each of said depressible buttons to reveal the latent image thereon, said microprocessor and said associated memory having means for performing game play which includes:

selecting one of said depressible buttons as a selected depressible button;

selectively illuminating said selected depressible buttons and producing its associated sounds;

illuminating a plurality of said depressible buttons and producing said associated sounds, said plurality of depressible buttons including said selected depressible button;

receiving a user input resulting from a user's attempt to identify said selected depressible button;

indicating an incorrect choice in the event the user's input is not said selected depressible button; and indicating a correct choice in the event the user's input is said selected depressible button.

11. The game set forth in claim 10 wherein said plurality of said depressible buttons illuminated in said illuminating step includes all of said depressible buttons.

12. The game set forth in claim 11 wherein said step of receiving a user input includes determining whether said user input is received within a response time.

13. The game set forth in claim 12 wherein said step of indicating a correct choice includes the step of establishing a reduced duration response time for the next game play.

14. The game set forth in claim 10 wherein said selecting step includes the step of selecting the loudest of said associated sounds.

15. The game set forth in claim 14 wherein said step of indicating a correct choice includes the steps of:

deleting the loudest of said associated sounds; and selecting the next loudest of'said associated sounds.

* * * * *